US009605678B2

(12) United States Patent
Favre et al.

(10) Patent No.: US 9,605,678 B2
(45) Date of Patent: Mar. 28, 2017

(54) FREE-FLOW PUMP

(75) Inventors: Jean-Nicolas Favre, Cressier (CH); Hagen Renger, Bochum (DE); Michel Grimm, St-Blaise (CH)

(73) Assignee: EGGER PUMPS TECHNOLOGY AG (CH)

( * ) Notice: Subject to any disclaimer, the term of this patent is extended or adjusted under 35 U.S.C. 154(b) by 764 days.

(21) Appl. No.: 14/003,274

(22) PCT Filed: Feb. 27, 2012

(86) PCT No.: PCT/EP2012/053261
§ 371 (c)(1),
(2), (4) Date: Sep. 5, 2013

(87) PCT Pub. No.: WO2012/119877
PCT Pub. Date: Sep. 13, 2012

(65) Prior Publication Data

US 2014/0003929 A1 Jan. 2, 2014

(30) Foreign Application Priority Data

Mar. 8, 2011 (EP) ..... 11157262

(51) Int. Cl.
*F04D 7/04* (2006.01)
*F04D 29/22* (2006.01)
*F04D 29/42* (2006.01)

(52) U.S. Cl.
CPC ..... *F04D 7/04* (2013.01); *F04D 29/2244* (2013.01); *F04D 29/426* (2013.01)

(58) Field of Classification Search
CPC ..... F04D 7/02; F04D 7/04; F04D 29/2216; F04D 29/242; F05D 2240/303
See application file for complete search history.

(56) References Cited

U.S. PATENT DOCUMENTS 3,167,021 A * 1/1965 Sence ..... F04D 7/04 415/131
4,592,700 A * 6/1986 Toguchi ..... F04D 29/2244 415/225
5,460,482 A * 10/1995 Dorsch ..... F04D 7/045 415/121.1

FOREIGN PATENT DOCUMENTS

CH EP 0109550 A2 * 5/1984 ..... F04D 29/2244
DE 19 30 566 A1 2/1970
(Continued)

OTHER PUBLICATIONS

International Search Report dated Apr. 5, 2013 issued in corresponding International Patent application No. PCT/EP2012/053261.

*Primary Examiner* — Eric Keasel
*Assistant Examiner* — Cameron Corday
(74) *Attorney, Agent, or Firm* — Ostrolenk Faber LLP

(57) ABSTRACT

The free-flow pump comprises an impeller (11, 22, 33) with an impeller base that is constituted by a front side (14, 5 24) of a hub body (12, 23) projecting at the center of the impeller (11, 22, 33) and by a disk surface (18, 28) located deeper than the front side (14, 24) of the hub body (12, 23) and reaching to an outer circumference of the impeller with its maximum depth. The disk surface (18, 28) is provided with vanes (19, 29, 34) comprising open vane front sides (20, 30, 35) adjoining the hub body (12, 23) at their inner end and extending from there to the outer circumference of the impeller (11, 22, 33). To avoid material accretions in front of the impeller (11, 22, 33) it is suggested that at least within an inner third of its radius, the impeller base is not located deeper with respect to the inner end of the vane front sides (20, 30, 35) than at most one sixth of the height difference (H) between the inner end of the vane front sides (20, 30, 35) and the maximum depth of the disk surface (18, 28).

8 Claims, 3 Drawing Sheets

(56) References Cited

FOREIGN PATENT DOCUMENTS

| | | | |
|---|---|---|---|
| EP | 0 081 456 | A1 | 6/1983 |
| EP | 0 649 987 | A1 | 4/1995 |
| GB | 2 136 509 | | 9/1984 |
| WO | WO 2004/065796 | A1 | 8/2004 |
| WO | WO 2004/065797 | A1 | 8/2004 |

* cited by examiner

R
11
12
13
14
15
16
17
18
19
20
24
42
1
2
3
4
5
6
7
8
9
25
r
$\frac{1}{3}$r
$\frac{1}{2}$r
Hn
$\frac{1}{6}$Hn
$\frac{2}{3}$Hn
III

22
R
29
30
24
43
28

22
R
29
23
27
28

21
4
8
r
1/3 r
1/2 r
VI
22
29
30
26
27
43
24
9
25
23
30
28
29
H
1/6 H
1/2 H
2/3 H
6
7
2
V
3
5

R
33
34
35
29
30
43
24
28
23
27
32
4
8
r
$\frac{1}{3}$r
$\frac{1}{2}$r
H
$\frac{1}{6}$H
$\frac{1}{2}$H
$\frac{2}{3}$H
IX
VIII
6
7
2
3
5
9
25
26
36

FREE-FLOW PUMP

CROSS REFERENCE TO RELATED APPLICATIONS

The present application is a 35 U.S.C. §371 National Phase conversion of PCT/EP2012/053261, filed Feb. 27, 2012, which claims benefit of European Application No. 11157262.4, filed Mar. 8, 2011, the disclosure of which is incorporated herein by reference. The PCT International Application was published in the English language.

TECHNICAL FIELD OF THE INVENTION

The present invention relates to a free-flow pump having an impeller that is spaced from an inlet in such a manner that a free passage for solids contained in the pumped liquid results between the inlet and an impeller exit, the impeller comprising an impeller base constituted by a front side of a hub body projecting at the center of the impeller and by a disk surface located deeper than the front side of the hub body and reaching to an outer circumference of the impeller with its maximum depth, the disk surface being provided with vanes comprising open vane front sides adjoining the hub body at their inner end and extending from there to the outer circumference of the impeller.

BACKGROUND OF THE INVENTION

Free-flow pumps of this kind, as they are known from EP 0 081 456 A1 to the applicant of the present invention, are often used in wastewater that is contaminated in particular with solid matter. In such pumps the distance between the impeller and the pump inlet is chosen such that a free flow space is formed between the inlet and the impeller exit, the free flow space constituting a passage for a sphere of a predetermined largest sphere diameter that can possibly be pumped so as to counteract the risk of clogging due to the solid components in the pumped liquid.

In practice, however, it has often been found that particularly tissue or knit materials consisting of fibers or yarns or other solids composed of two-dimensional and flexible materials tend to accumulate at the impeller front surface and obstruct the desired unimpeded passage through the vane-free space. More specifically, a short-term or even permanent accretion of such materials has been observed in the central area of the impeller. This material accretion in front of the impeller surface causes an undesirable reduction of the pumping head and of the efficiency or leads first to a reduction of the flow rate and ultimately to total clogging of the pump.

SUMMARY OF THE INVENTION

It is an object of the present invention to develop a free-flow pump of the kind mentioned in the introduction so as to prevent the accretion of two-dimensional materials in front of the rotation surface of the impeller to ensure an undisturbed pumping operation.

This object is attained by the free-flow pump according to claim 1. The dependent claims define preferred embodiments.

Thus, according to the invention, a free-flow pump is suggested where at least within an inner third of its radius, the base of the impeller is not located deeper with respect to the inner end of the vane front sides than at most one sixth of the height difference between the inner end of the vane front sides and the maximum depth of the disk surface.

For it was surprisingly found in the context of the present invention that by a thus caused reduction of the suction effect in the central area of the impeller and a resulting enlargement of the flow path around this central area, the aforementioned accretion of two-dimensional materials can be significantly reduced or even entirely prevented over the entire impeller front surface.

The construction of the impeller is preferably optimized such that a reduction of the pump efficiency can be kept as low as possible in order to ensure the clog-free operation of the free-flow pump in a large number of applications. According to the invention it has been found to be essential in this respect that the disk surface reaches to the outer circumference of the impeller with its maximum depth. In this manner the pressure buildup required for producing the useful flow and the acceleration of the vortex in the flow space can be kept quite high and thus a relatively high pumping head can be achieved during a clog-free operation of the free-flow pump.

In order to further reduce the accretion of two-dimensional and flexible materials in the inlet area of the vane channels it is suggested that at least within an inner half of its radius, the impeller base is preferably not located deeper with respect to the inner end of the vane front sides than at most two thirds of the height difference between the inner end of the vane front sides and the maximum depth of the disk surface. More preferred, the impeller base is not located deeper than at most one half of this height difference relative to the inner end of the vane front sides.

To maintain a quite high pump efficiency, the height difference of the disk surface within a middle third of the radius of the impeller is preferably larger than half, more preferred larger than two thirds, of the height difference between the inner end of the vane front sides and the maximum depth of the disk surface.

An effective flow through the impeller can be achieved in that the disk surface comprises a surface portion continuously declining towards the outer circumference. Preferably, this surface portion extends over at least one third, more preferred over at least half, of the impeller radius. Most preferred, the continuously declining surface portion extends over at least two thirds of the impeller radius. With such an impeller geometry, a pump efficiency that is sufficient for many applications and the prevention of an undesirable accretion of two-dimensional materials in front of the impeller surface can be advantageously combined. In an advantageous embodiment of the invention, the continuously declining surface portion reaches to the outer circumference of the impeller.

Alternatively, the disk surface may comprise an essentially flat surface portion that extends at most over the outer two thirds, preferably at most over the outer half of the impeller radius. In this case, the flat disk surface may e.g. directly adjoin to the front side of the hub body along an abrupt rise in height. Thus, for example, the disk surface may exhibit a substantially stepped decline within a middle third of its radius.

Another advantageous embodiment of the impeller according to the invention may comprise that the disk surface adjoins the front side of the hub body continuously along a curved surface portion. The curvature may contribute to the prevention of an accretion of two-dimensional materials in the impeller inlet area. In particular, a convex curvature may be employed. It may further be useful in this respect that the open vane front sides may adjoin the hub body in the area of the front side thereof. Furthermore it can be advantageous in this respect that the front side of the hub body has a substantially flat configuration. However, a steeper shape of the surfaces on the front side may also be contemplated.

To achieve optimum HQ characteristics, which characterize the functional dependence between the pumping head and the flow rate, a curved shape of the vane front sides towards the outer circumference of the impeller may be advantageous.

According to another advantageous embodiment of the invention, the height of at least two vanes increases towards the outer circumference of the impeller. This may contribute to an increase in pump efficiency as in this manner an increased force is applied to the pumped liquid exiting the impeller in the radial direction.

BRIEF DESCRIPTION OF THE DRAWINGS

The invention is explained in more detail hereinafter by means of preferred embodiments with reference to the drawings which illustrate further properties and advantages of the invention. The figures, the description, and the claims comprise numerous features in combination that one skilled in the art may also contemplate separately and use in further appropriate combinations. The drawings show:

DESCRIPTION OF PREFERRED EMBODIMENTS

Figures 1, 2, 3:
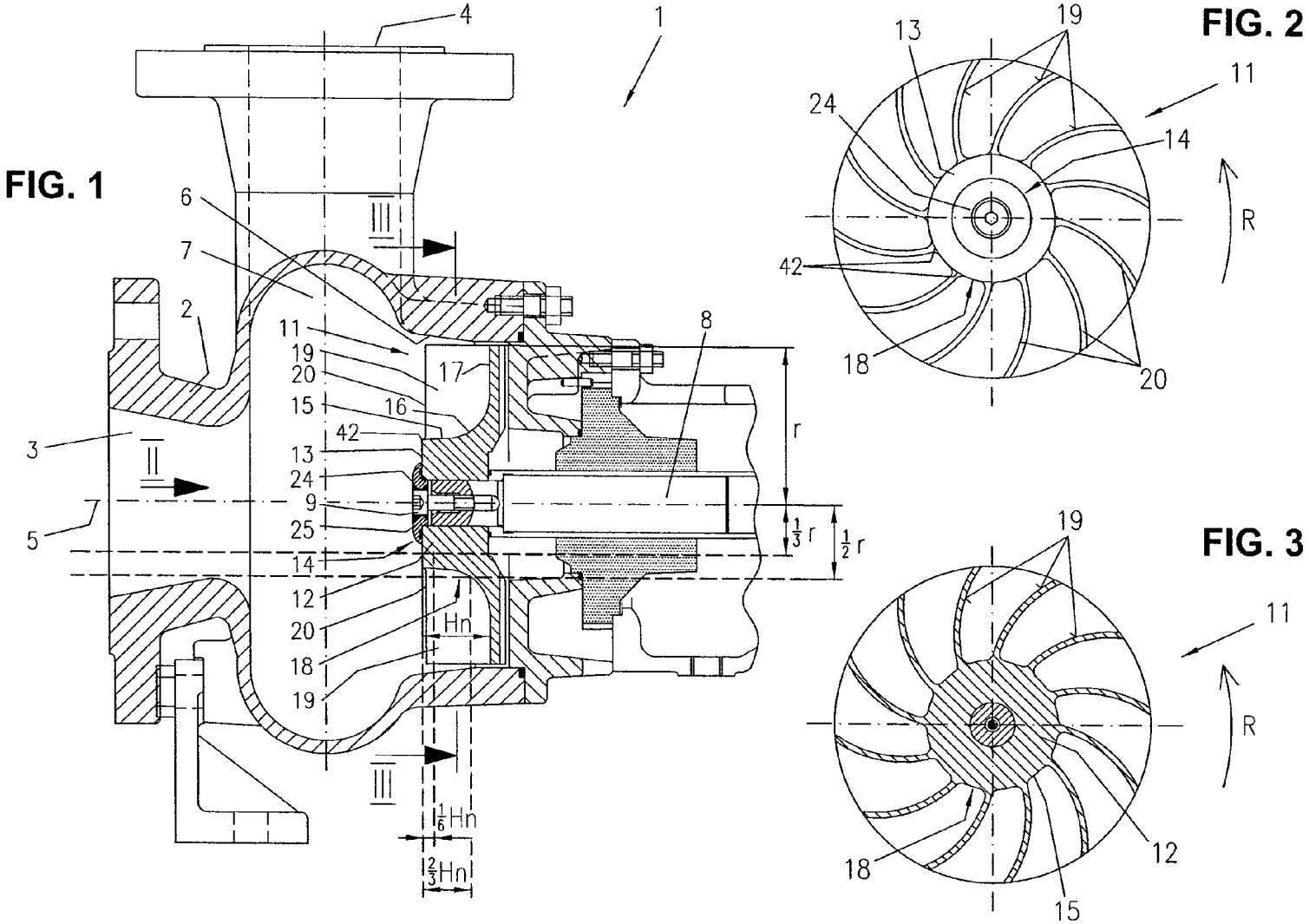
FIG. 1: a meridian section through a free-flow pump according to a first embodiment.
FIG. 2: a front view of the impeller according to II of the free-flow pump shown in FIG. 1.
FIG. 3: a cross-section of the impeller according to III of the free-flow pump shown in FIG. 1.

A free-flow pump 1 shown in FIG. 1 comprises a pump enclosure 2 having a frontal inlet opening 3 and a laterally arranged outlet opening 4. Pump enclosure 2 encloses an impeller chamber 6.

In impeller chamber 6, an impeller 11 is arranged at such a distance from inlet opening 3 that a free passage 7 for solids contained in the pumped liquid results towards outlet opening 4. Impeller 11 has a hub body 12 in which a shaft 8 is fastened. Shaft 8 extends along longitudinal axis 5 into the rearward part of pump enclosure 2 where it is connected to a drive not represented in the figure.

Hub body 12 includes a front plate 25 whose free surface 24 forms the central portion of the front side 14 of hub body 12. The surface 24 of front plate 25 has a substantially flat shape. Front plate 25 has a central bore for receiving a screw 9 and a gently rounded edge that is followed in the radially outward direction by a flat frontal surface portion 13 of hub body 12. Thus, front side 14 of hub body 12 has a substantially flat overall shape and extends over a little more than a third of the total radius of impeller 11.

Front side 14 of hub body 12 abruptly connects to an outer wall 15 of hub body 12 and forms a step therewith. This surface portion 15 adjoining the front side 14 of hub body 12 extends substantially in parallel with respect to the longitudinal axis 5 of pump enclosure 2 over half of the impeller depth and is then followed by a concavely curved portion 16.

The concavely curved surface portion 16 of hub body 12 extends approximately over the middle third of the radius r of impeller 11 and then reaches its maximum depth relative to front side 14 of hub body 12. At this point, the concavely curved portion 16 is followed by a flat surface portion 17 that extends substantially perpendicularly to the longitudinal axis 5 of pump enclosure 2. This flat portion 17 extends over the entire outer third of the radius of impeller 11 and reaches to its outer circumference.

The disk surface 18 formed by surface portions 15-17 is provided with vanes 19. Vanes 19 each extend from their inner ends 42 adjoining portion 15 of hub body 12, which is substantially parallel to longitudinal axis 5 to the outer circumference of impeller 11. Vanes 19 have a substantially constant height characteristics. The height H of vanes 19 is equal to the height difference Hn between the flat surface portion 17 and the abrupt junction between front side 14 and external wall 15 of hub body 12, or slightly smaller.

FIG. 2 shows a top view of front side 14 of hub body 12 and of the surrounding disk surface 18 constituting the impeller base of impeller 11. Twelve vanes 19 are arranged around disk surface 18 at regular intervals. The open vane front sides 20 of vanes 19 adjoin the junction between front side 14 of hub body 12 and disk surface 18. From there, vane front sides 20 extend to the outer circumference of impeller 11 in a curved shape while their thickness remains constant. The direction of curvature of vanes 19 is opposed to the direction of rotation R of impeller 1.

FIG. 3 shows a cross-sectional view of impeller 11 according to section III in FIG. 1. This corresponds to a section through impeller 11 along half of the height difference H between the inner end of vane front sides 20 and the maximum depth of disk surface 18, measured by its distance from the surface portion of the inner ends of vane front sides 20 which is closest to the inlet side. As follows from FIG. 3, in this depth range of impeller 11, disk surface 18 lies at the same height as surface portion 15 of hub body 12 that is located in the middle third of the radius of the impeller 11.

The free-flow pump 1 described above allows pumping liquids that are e.g. contaminated with cloths or rags without clogging impeller chamber 6. The tendency of two-dimensional materials to deposit on the front side of impeller 11 can be effectively counteracted by the described geometry of impeller 11.

Figure 4:
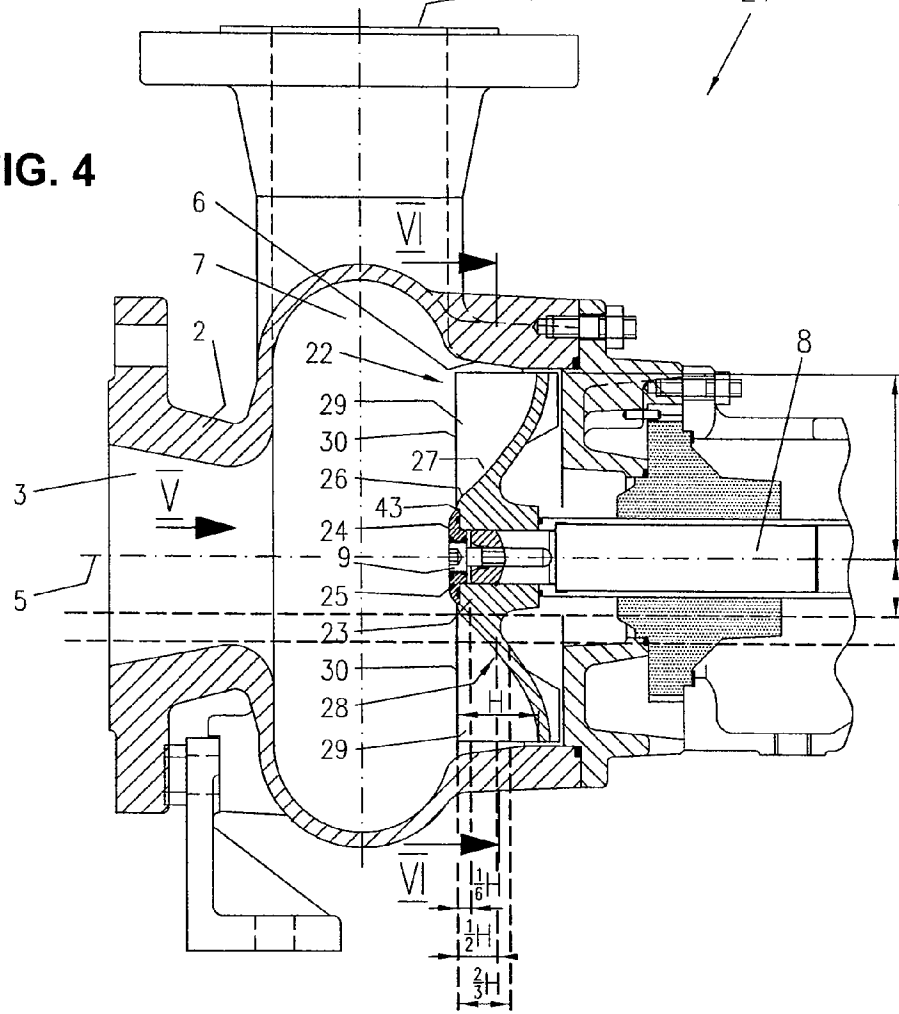
FIG. 4: a meridian section through a free-flow pump according to a second embodiment.

In FIG. 4 a free-flow pump 21 according to a second embodiment is illustrated. Components that are designed identically with regard to free-flow pump 1 shown in FIG. 1 are designated by the same reference numerals. The essential difference of free-flow pump 21 as compared to the previously described free-flow pump 1 consists in a different geometry of its impeller 22. On one hand, this impeller geometry also allows avoiding clogging of impeller chamber 6 by two-dimensional materials, and on the other hand, the losses in efficiency of free-flow pump 21 can be kept sufficiently small for many applications. In particular, the following constructive measures are provided:

Impeller 22 has a hub body 23 whose front side 24 extends over approximately one third of the radius r of impeller 22. Front side 24 of hub body 23 is substantially constituted by the free surface of front plate 25 that forms a continuous junction with a surrounding convex curvature 26 on the external wall of hub body 23. The free surface of front plate 25 consists of the flat middle surface portion comprising the central bore for receiving screw 9 and of the gently rounded outer taper to which the convex curvature 26 on the external wall of hub body 23 adjoins. The flat middle surface portion extends over more than two thirds of the radius of front plate 25.

The disk surface 28 around front side 24 of hub body 23 extends over the outer two thirds of the radius of impeller 22. Disk surface 28 consists of the convexely curved surface portion 26 and of an adjoining concavely curved surface portion 27 both of which extend along the external wall of hub body 23. The convexely curved surface portion 26 here only corresponds to about a seventh of the radius of disk surface 28.

Disk surface 28 is provided with vanes 29 comprising open vane front sides 30. Vane front sides 30 adjoin the front side 24 of hub body 23 in the area of its convexely curved junction 26 with disk surface 28. From there, vanes 29 extend to the outer circumference of impeller 22. Vanes 29 exhibit a constant height characteristics, their height H substantially corresponding to the height difference between the concavely curved surface portion 27 at the outer circumference of impeller 22 and the convexely curved junction 26 with disk surface 28.

The maximum depth of disk surface 28 is equal to its maximum height difference H from the surface portion of the inner ends 43 of vane front sides 30 which is closest to the inlet side. Thus, disk surface 28 only reaches its maximum depth along its outer circumference where the concavely curved surface portion 27 reaches the outer circumference of impeller 22.

Accordingly, the impeller base of impeller 22, constituted as a whole by front side 24 of hub body 23 and by the surrounding disk surface 28, in its inner radial third only consists of the front side 24 of hub body 23. Therefore, the height variation of the impeller base in this area substantially corresponds to the height characteristic of front plate 25, which in its outer edge area only exhibits a small height variation as compared to the height difference H.

Figure 5:
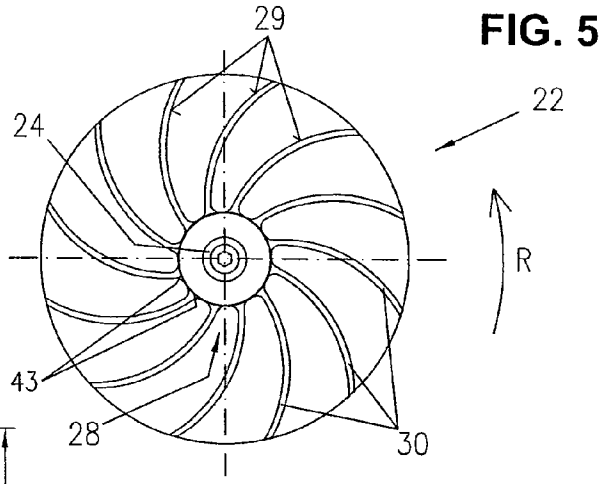
FIG. 5: a front view of the impeller according to V of the free-flow pump shown in FIG. 4.

FIG. 5 shows a top view of front side 24 of hub body 23 and of the surrounding disk surface 28 forming the impeller base. Twelve vanes 29 are arranged in regular intervals around disk surface 28. Starting from the junction between the front side 24 of hub body 23 and disk surface 28, the vanes 29 extend to the outer circumference of impeller 22. The vane front sides 30 of vanes 29 exhibit a curved shape.

Figure 6:
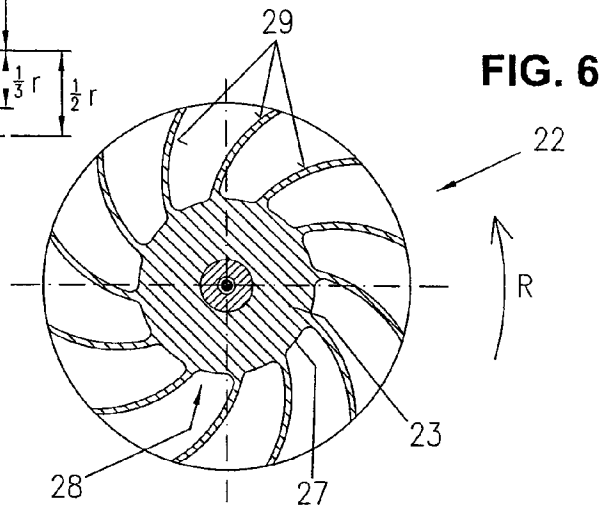
FIG. 6: a cross-section of the impeller according to VI of the free-flow pump shown in FIG. 4.

FIG. 6 shows a cross-sectional view of impeller 22 according to section VI in FIG. 4. This corresponds to a section through impeller 22 along half of the height difference H between the inner end of vane front sides 20 and the maximum depth of disk surface 28 relative to the inner end of vane front sides 20. As follows from FIG. 6, in this depth range, disk surface 28 lies in the middle of the radius of impeller 22 within the concavely curved surface portion 27 of the latter.

Figures 7, 8, 9:
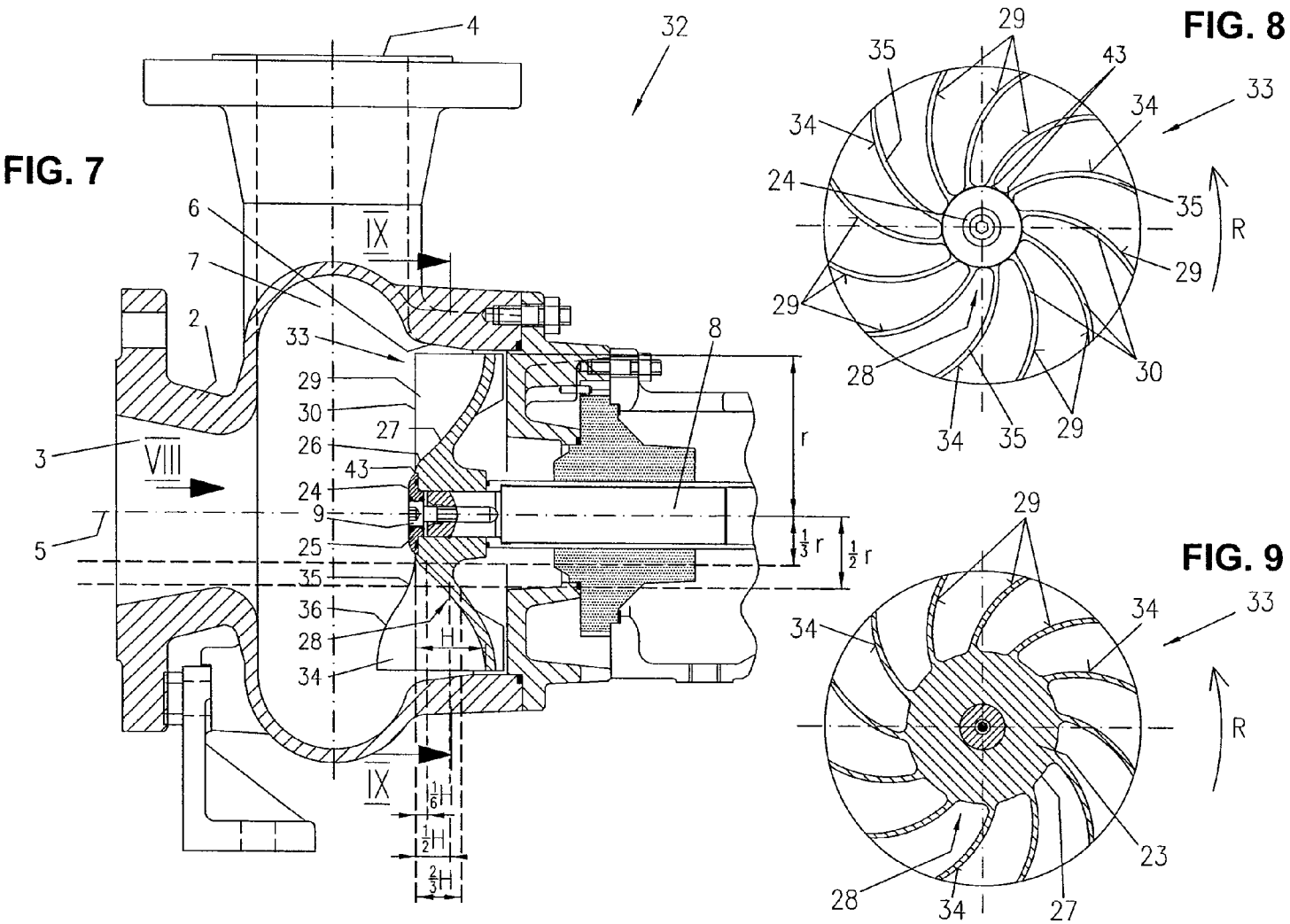
FIG. 7: a meridian section through a free-flow pump according to a third embodiment.
FIG. 8: a front view of the impeller according to VIII of the free-flow pump shown in FIG. 7.
FIG. 9: a cross-section of the impeller according to IX of the free-flow pump shown in FIG. 7.

In FIG. 7 a free-flow pump 32 according to a third embodiment is illustrated. Components that are designed identically with regard to free-flow pump 1, 21 shown in FIG. 1 and FIG. 4 are designated by the same reference numerals. Free-flow pump 21 substantially corresponds to the previously described free-flow pump 21 with the difference that the vane geometry of impeller 22 is modified in order to improve the pump efficiency.

In addition to vanes 29 of constant height, impeller 33 of free-flow pump 32 further comprises vanes 34 of variable height. At their inner ends, the open vane front sides 35 of vanes 34 of variable height also adjoin to front side 24 of hub body 23 in the area of its convexely curved junction 26 with disk surface 28. From there, vanes 34 extend to the outer circumference of impeller 33 while their height continuously increases. The maximum height increase 36 of vanes 34 is in the outer third of the radius of impeller 33. From there towards the outer circumference of impeller 33, the height increase of vanes 34 declines until their height remains substantially constant over the outer tenth of the radius of impeller 33.

Accordingly, the height of vanes 34 remains substantially constant over the inner radial half of the impeller base. Then, in the outer radial half of the impeller base, a rapid height increase follows where the height of vanes 34 increases about a fourth of the maximum depth of disk surface 28 relative to front side 24 of hub body 25. In this manner, an increase in pumping head and pump efficiency is achieved without having to accept disadvantageous clogging properties due to two-dimensional materials contained in the pumped liquid.

FIG. 8 shows a top view of impeller 33. Around disk surface 28, three vanes 34 of variable height are arranged at regular intervals and in between them three vanes 29 of constant height. The free vane front sides 35 of vanes 34 of variable height have substantially the same shape properties as vane front sides 30 of vanes 29 of constant height, particularly with regard to their relative distance to neighboring vanes 29 and their curved shape.

The arrangement of vanes 29 of constant height therebetween serves the purpose of temporarily ensuring the opening of free passage 7 for the passage of larger solids in the pumped liquid during an impeller rotation.

FIG. 9 shows a cross-sectional view of impeller 33 according to section IX in FIG. 7. This corresponds to a section through impeller 33 along half of the height difference H between the inner end of vane front sides 30, 35 and the maximum depth of disk surface 28. As follows from a comparison of FIG. 6 to FIG. 9, this section is identical to the equivalent cross-section VI through impeller 22 of free-flow pump 21 shown in FIG. 4.

From the foregoing description, numerous modifications of the free-flow pump according to the invention are apparent to one skilled in the art without leaving the scope of protection of the invention that is solely defined by the claims.

What is claimed is:

1. A free-flow pump comprising an impeller spaced from an inlet in such a manner that a free passage for solids contained in pumped liquid results between the inlet and an impeller exit, the impeller comprising:

an impeller base comprising a front side of a hub body projecting at a center of the impeller and a disk surface located deeper seen in the direction of a rotation axis of the impeller than the front side of the hub body and reaching to an outer circumference of the impeller with its maximum depth;

the disk surface comprising vanes comprising open vane front sides adjoining the hub body at their inner end and extending from the inner end to an outer circumference of the impeller, wherein within an inner third of a disk surface radius, the disk surface is located at most at a first predetermined depth with respect to the inner end of the vane front sides seen in the direction of the rotation axis of the impeller, the first predetermined depth being a depth at most one sixth of a height difference (H) between the inner end of the vane front sides and a maximum depth of the disk surface, wherein within an inner half of the disk surface radius, the disk surface is located at most at a second predetermined depth with respect to the inner end of the vane front sides seen in the direction of the rotation axis of the impeller, the second predetermined depth being a depth at most two thirds of the height difference between the inner end of the vane front sides and the maximum depth of the disk surface, wherein the disk surface comprises a surface portion continuously declining toward the outer circumference of the impeller, and wherein said surface portion extends over one half or more of the radius of the impeller.

2. The free-flow pump according to claim 1, wherein the disk surface continuously connects to the front side of the hub body along a curved surface portion.

3. The free-flow pump according to claim 1, wherein the vane front sides adjoin the hub body at its front side.

4. The free-flow pump according to claim 1, wherein the height of at least two vanes increases towards the outer circumference of the impeller.

5. The free-flow pump according to claim 1, wherein the vane front sides have a curved shape.

6. The free-flow pump according to claim 1, wherein the front side of the hub body has a substantially flat shape.

7. The free-flow pump according to claim 1, wherein within a middle third of the radius of the impeller, the height difference of the disk surface is larger than half of the height difference between the inner end of the vane front sides and the maximum depth of the disk surface.

8. The free-flow pump according to claim 1, wherein at least within an inner half of its radius, the disk surface is located at most at a third predetermined depth with respect to the inner end of the vane front sides, the third predetermined depth being a depth at most half of the height difference between the inner end of the vane front sides and the maximum depth of the disk surface.

* * * * *